US010578390B2

(12) United States Patent
Pintar

(10) Patent No.: US 10,578,390 B2
(45) Date of Patent: Mar. 3, 2020

(54) REVERSE MOUNT WEAPON SECURITY APPARATUS AND METHOD

(71) Applicant: Blac-Rac Manufacturing, Inc., Boise, ID (US)

(72) Inventor: Kevin B. Pintar, Meridian, ID (US)

(73) Assignee: BLAC-RAC MANUFACTURING, INC., Boise, ID (US)

( * ) Notice: Subject to any disclaimer, the term of this patent is extended or adjusted under 35 U.S.C. 154(b) by 0 days.

(21) Appl. No.: 15/837,665

(22) Filed: Dec. 11, 2017

(65) Prior Publication Data

US 2019/0178599 A1 Jun. 13, 2019

(51) Int. Cl.

| | |
|---|---|
| ***F41A 23/18*** | (2006.01) |
| ***A47B 81/00*** | (2006.01) |
| ***F41A 17/44*** | (2006.01) |
| ***F41A 17/54*** | (2006.01) |

(52) U.S. Cl.

CPC ..... *F41A 23/18* (2013.01); *A47B 81/005* (2013.01); *F41A 17/44* (2013.01); *F41A 17/54* (2013.01)

(58) Field of Classification Search

CPC ..... F41A 23/00; F41A 23/005; F41A 23/18; F41A 23/26; F41A 17/00; F41A 17/02; F41A 17/04; F41A 17/06; F41A 17/36; F41A 17/44; A47B 81/005; A47B 81/00; B60R 7/14

USPC ..... 42/70.11, 70.01, 94

See application file for complete search history.

(56) References Cited

U.S. PATENT DOCUMENTS 1,513,267 A * 10/1924 Parks ..... F41A 17/02 42/70.11
2,316,995 A * 4/1943 Smith ..... A47B 81/005 211/64
2,668,645 A * 2/1954 Pease ..... B60R 7/14 211/64
3,473,673 A * 10/1969 Porter ..... A47B 81/005 211/64
3,507,398 A * 4/1970 Schaefer ..... A47B 81/005 211/4
3,802,612 A * 4/1974 Smith ..... B60R 7/14 211/64
4,113,107 A * 9/1978 Jaeger ..... A47B 81/005 211/4
4,139,100 A * 2/1979 Reed ..... F41A 17/02 211/4
4,936,531 A * 6/1990 Bauser ..... B60N 3/00 211/64
5,138,786 A * 8/1992 Fischer ..... E05B 73/00 211/64
5,309,661 A * 5/1994 Fuller ..... F41A 17/54 42/70.07
5,350,094 A * 9/1994 Morford ..... B60R 7/14 211/64
5,487,234 A * 1/1996 Dragon ..... F41A 17/06 340/571

(Continued)

*Primary Examiner* — Derrick R Morgan

(74) *Attorney, Agent, or Firm* — Parsons Behle & Latimer

(57) ABSTRACT

A weapon security apparatus may include a base assembly. The apparatus may further include a first grip plate. The apparatus may also include a second grip plate, the second grip plate moveable between an open position and a closed position relative to the first grip plate, the first grip plate and the second grip plate configured to receive a weapon therebetween and to secure the weapon with a top side of the weapon facing the base assembly.

20 Claims, 4 Drawing Sheets

(56) References Cited

U.S. PATENT DOCUMENTS 5,621,996 A * 4/1997 Mowl, Jr. ..... F41A 23/18 211/64
5,768,819 A * 6/1998 Neal ..... F41A 17/00 42/70.07
5,979,846 A * 11/1999 Fluhr ..... B60R 7/14 211/64
6,009,654 A * 1/2000 Williams ..... F41C 33/06 206/317
6,142,313 A * 11/2000 Young ..... F41A 17/02 211/4
6,330,815 B1 * 12/2001 Duncan ..... B60R 7/14 211/4
6,427,497 B1 * 8/2002 Mossberg ..... A47B 81/005 211/4
6,438,885 B1 * 8/2002 Murray ..... F41A 17/54 211/64
6,845,640 B2 * 1/2005 Loeff ..... E05B 53/003 109/45
7,658,028 B2 * 2/2010 Pintar ..... F41A 17/02 42/70.06
8,266,835 B2 * 9/2012 Pintar ..... F41A 17/02 42/70.06
D670,351 S * 11/2012 Skaggs, Sr. ..... D22/108
8,316,571 B1 * 11/2012 Holland ..... 42/108
8,403,278 B1 * 3/2013 Kasbohm ..... F41C 33/06 211/64
8,826,702 B1 * 9/2014 Barger ..... E05B 73/00 211/4
9,010,007 B2 * 4/2015 Chandler ..... F41A 17/04 206/315.11
9,482,482 B1 * 11/2016 Sanders ..... E05B 73/00
9,841,250 B1 * 12/2017 Mirza ..... F41A 17/54
9,885,534 B2 * 2/2018 Boggess ..... F41A 23/18
2002/0116856 A1 * 8/2002 Troyer ..... F41A 17/04 42/70.11
2003/0066228 A1 * 4/2003 Smith ..... F41A 17/54 42/70.11
2003/0150972 A1 * 8/2003 Murray ..... B60R 7/14 248/682
2005/0145585 A1 * 7/2005 Pintar ..... A47B 81/005 211/64
2006/0243678 A1 * 11/2006 Crowell ..... F41A 23/18 211/4
2007/0000851 A1 * 1/2007 Matzick ..... A47B 81/005 211/64
2007/0013478 A1 * 1/2007 Crigger ..... A47B 81/005 340/5.53
2008/0178509 A1 * 7/2008 Pintar ..... F41A 17/02 42/70.07
2010/0107465 A1 * 5/2010 Pintar ..... F41A 17/02 42/70.07
2010/0301184 A1 * 12/2010 Stabler ..... F16M 11/16 248/346.5
2011/0173868 A1 * 7/2011 Wilson ..... F41A 23/18 42/95
2011/0290837 A1 * 12/2011 Smith ..... B60R 7/14 224/413
2012/0005935 A1 * 1/2012 Chandler ..... F41A 17/04 42/70.11
2012/0193254 A1 * 8/2012 Kubiniec ..... A47B 81/005 206/317
2012/0255212 A1 * 10/2012 Werner ..... F41A 23/18 42/90
2013/0269509 A1 * 10/2013 Irwin ..... F41A 23/005 89/37.01
2014/0263107 A1 * 9/2014 Arabian ..... B60R 7/14 211/8
2015/0128668 A1 * 5/2015 Meredith ..... F41A 23/18 70/266
2016/0238337 A1 * 8/2016 Hull ..... B60R 7/14
2016/0327355 A1 * 11/2016 Zalavari ..... F41A 17/02
2017/0122010 A1 * 5/2017 McCanna ..... E05B 73/00
2017/0336162 A1 * 11/2017 Plourde ..... F41A 17/06
2017/0361777 A1 * 12/2017 Bornais ..... F41A 23/18
2018/0094892 A1 * 4/2018 Bowe, Jr. ..... F41A 23/18
2018/0238650 A1 * 8/2018 Stockton ..... A47B 81/00
2018/0297535 A1 * 10/2018 McDonald ..... B60R 7/14

* cited by examiner

REVERSE MOUNT WEAPON SECURITY APPARATUS AND METHOD

FIELD OF THE DISCLOSURE

This disclosure relates generally to weapon security and more particularly to weapon security apparatuses where a top of a weapon is mounted with a top of the weapon facing a base of the weapons mounting system.

BACKGROUND

Weapon security devices provide measures to prevent unauthorized access to a weapon by locking key portions of the weapon, thereby neutralizing it while in the security device. Locking mechanisms may be used to enclose, or otherwise contain, the key portions of the weapon. Examples, of weapon security devices are described with reference to U.S. patent application Ser. No. 15/264,777, filed Sep. 14, 2016 and entitled "Systems and Methods to Prevent Hot-Wiring of Electronic Gun Racks," with reference to U.S. Pat. No. 8,266,835 filed on Jan. 6, 2010 and entitled "Firearm Security Device," and with reference to U.S. Pat. No. 7,658,028 filed on Jan. 30, 2008 and entitled "Firearm Security Device," the contents of each of which are hereby incorporated by reference in their entirety.

In a typical configuration, weapon security devices may secure a weapon with a top of the weapon facing outward from a base of the security device and with an underside of the weapon facing toward the base. This configuration may allow access to the receiver of the weapon, which may, in some cases, enable a person to charge the weapon while it is secured. Further, because the under portion of the weapon faces the base, typical weapon security devices may block or otherwise prevent a weapon from being secured with a high capacity magazine attached thereto. Other disadvantages may exist.

SUMMARY

The present disclosure addresses at least some of the potential disadvantages of typical gun racks. For example, a weapon security device may enable a weapon to be reverse mounted such that a top of the weapon is facing a base of the device and an underside of the weapon is facing away from the base. In this configuration, the base may prevent charging of the weapon. Further, the weapon may be mounted within the device while having a high capacity magazine attached to its underside. Other advantages may exist.

In an embodiment, a weapon security apparatus includes a base assembly, a first grip plate, and a second grip plate. The second grip plate is moveable between an open position and a closed position relative to the first grip plate, the first grip plate and the second grip plate configured to receive a weapon therebetween and to secure the weapon with a top side of the weapon facing the base assembly.

In some embodiments, the apparatus includes a first grip pad attached to the first grip plate and a second grip pad attached to the second grip plate. In some embodiments, the first grip pad and the second grip pad comprise synthetic rubber. In some embodiments, the base assembly blocks access to a chamber of the weapon to prevent charging of the weapon while the weapon is secured between the first grip plate and the second grip plate. In some embodiments, the first grip plate and the second grip plate are adapted to retain a predetermined shape corresponding to an automatic rifle and to retain a predetermined shape corresponding to a shotgun. In some embodiments, the apparatus includes at least one structural post coupled to one of the first plate or the second plate and configured to retain the weapon when the second plate is in the closed position. In some embodiments, a distance between the first plate and the second plate while the second plate is in the closed position is adjustable to accommodate different sized weapons. In some embodiments, the apparatus includes a handle assembly configured to enable a user to move the second plate between the open position and the closed position. In some embodiments, the first plate and the second plate include stainless steel.

In an embodiment, a method for weapon security includes providing a base assembly. The method further includes providing a first grip plate. The method also includes providing a second grip plate, the second grip plate moveable between an open position and a closed position relative to the first grip plate, the first grip plate and the second grip plate configured to receive a weapon therebetween and to retain the weapon with a top side of the weapon facing the base assembly.

In some embodiments, the method includes providing a first grip pad attached to the first grip plate and a second grip pad attached to the second grip plate. In some embodiments, the base assembly prevents access to a chamber of the weapon to prevent charging of the weapon while the weapon is locked between the first grip plate and the second grip plate. In some embodiments, the first grip plate and the second grip plate are adapted to retain a predetermined shape corresponding to an automatic rifle and to retain a predetermined shape corresponding to a shotgun. In some embodiments, the method includes providing at least one structural post coupled to one of the first grip plate or the second grip plate and configured to retain the weapon when the second grip plate is in the closed position. In some embodiments, the method includes providing a first synthetic rubber grip pad attached to the first grip plate and a second synthetic rubber grip pad attached to the second grip plate. In some embodiments, a distance between the first grip plate and the second grip plate is adjustable to accommodate different sized weapons. In some embodiments, the method includes providing a handle assembly configured to enable a user to move the second grip plate between the open position and the closed position. In some embodiments, the first grip plate and the second grip plate include stainless steel.

In an embodiment, a weapon security apparatus includes a base assembly. The apparatus further includes a lock assembly configured to receive a weapon therein and to retain the weapon while in a locked state and to release the weapon when in the unlocked state, where the weapon is retained with a top side of the weapon facing the base assembly.

In some embodiments, the lock assembly includes a first grip plate and a second grip plate, the second grip plate moveable between an open position and a closed position relative to the first plate.

Figure 1:
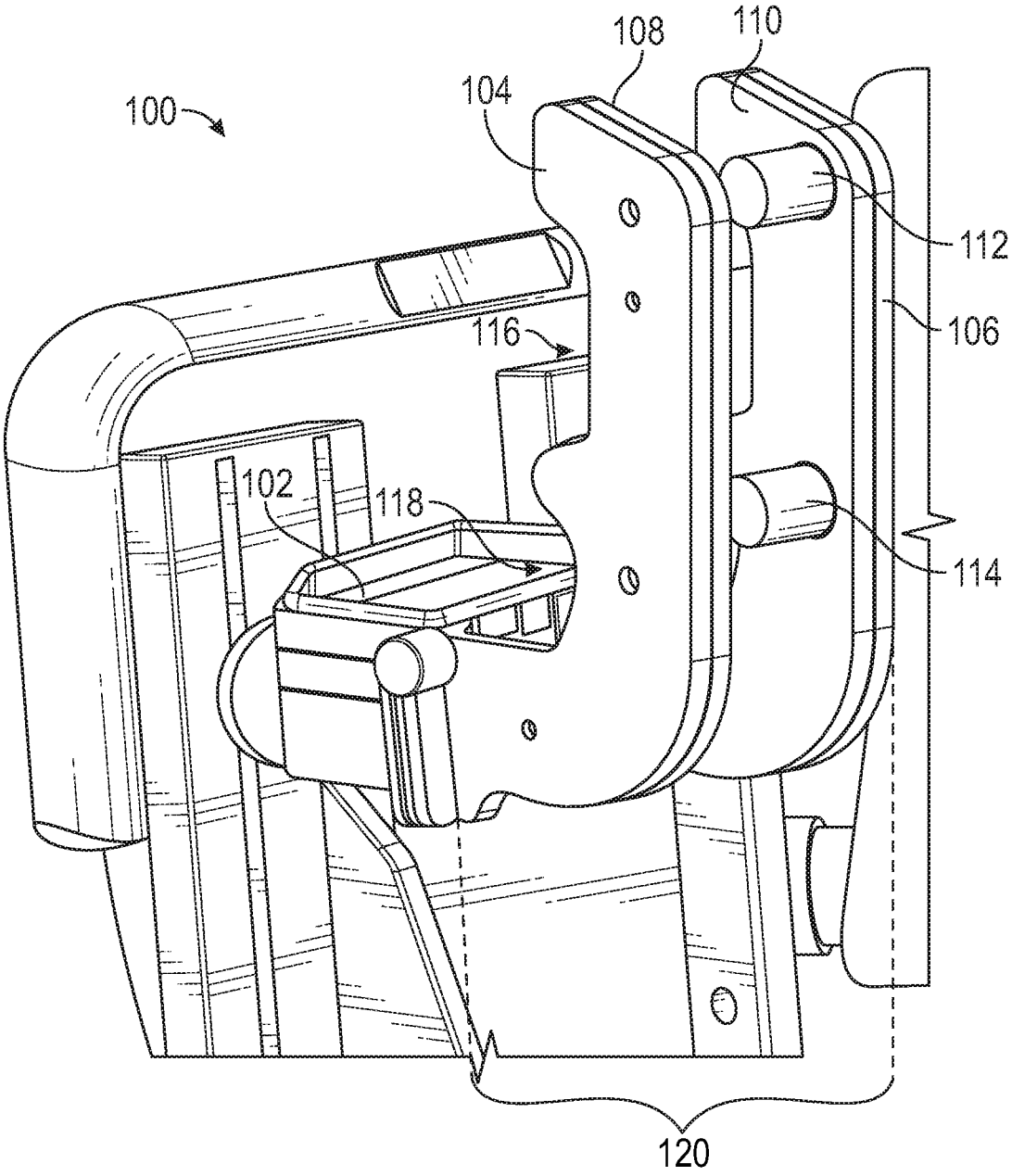
FIG. 1 depicts an embodiment of a weapon security apparatus in an unlocked and open state.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the disclosure as defined by the appended claims.

DETAILED DESCRIPTION

Referring to FIG. 1, an embodiment of a weapon security apparatus 100 is depicted. As described herein, a weapon may be inserted into the apparatus 100 to secure the weapon. The design of the apparatus 100 may enable the weapon to be inserted in a reverse orientation with a topside of the weapon facing toward the apparatus 100 and an underside of the weapon facing away from the apparatus 100.

The apparatus 100 may include a base assembly 102 with a first grip plate 104 and a second grip plate 106 attached thereto. Various mechanisms may be provided within the base assembly 102 for moving and the grip plates 104, 106 between an open and closed position and for locking and securing the grip plates 104, 106 in the closed position to secure a weapon. For example, in the embodiment depicted in FIG. 1, the second grip plate 106 may move between an open position where a distance between the grip plates 104, 106 is sufficient to enable a weapon to be inserted therebetween, and a closed position, where a distance between the grip plates 104, 106 is small enough to prevent a weapon positioned between the grip plates 104, 106 from being removed. The grip plates 104, 106 may be formed from a hardened material, such as stainless steel. Other materials may also be included.

Together, the first grip plate 104 and the second grip plate 106 may form a lock assembly 120. When the second grip plate 106 is in the closed position, the lock assembly 120 may be in a locked state, preventing removal of a weapon. When the second grip plate 106 is in the open position, the lock assembly 120 may be in an unlocked state, enabling removal of the weapon. In order to move the second grip plate 106 between the open and closed positions, and to prevent access to a weapon, the base assembly 102 may include retractable latches, locking pins, solenoids for electronic access, other types of locking mechanisms, or combinations thereof. The mechanisms (not shown) may be housed within a secured and tamper proof portion of the base assembly 102.

The first grip plate 104 may include a first grip pad 108. Likewise, the second grip plate 106 may include a second grip pad 110. When a weapon is inserted between the grip plates 104, 106, the grip pads 108, 110 may provide cushioning and a constant force against the weapon for support. In order to provide cushioning, the grip pads 108, 110 may be made from a flexible, or semi-flexible material. For example, the grip pads 108, 110 may include a synthetic rubber material.

The first grip plate 104, the second grip plate 106, or both may include structural posts to support and retain a weapon that is inserted into the apparatus 100. For example, as depicted in FIG. 1, the second grip plate 106 may include a first structural post 112 and a second structural post 114. When the second grip plate 106 is in the open position, the structural posts 112, 114 may leave a gap relative to the first grip plate 104 allowing a weapon to be inserted between the plates. When the second grip plate 106 is moved to the closed position, as will be described with reference to FIG. 2, the structural posts 112, 114 may retain a weapon and prevent its removal from between the grip plates 104, 106. The structural posts 112, 114 may further provide support for a weapon in addition to the grip pads 108, 110.

As depicted in FIG. 1, the grip plates 104, 106 may include troughs defined therein. For example, a shape of the first grip plate 104 may define a first trough 116 and a second trough 118. Similar troughs may be defined within a shape of the second grip plate 106. The troughs 116, 118 may enable the plates to match the shape of a weapon inserted therein in a reverse configuration with a top of the weapon facing toward the base 102 and an underside of the weapon facing away from the base 102. For example, the troughs 116, 118 may accommodate a portion of a receiver or another portion of a weapon. In some embodiments, the grip plates 104, 106 are adapted to retain multiple weapons of different predetermined shapes. The predetermined shapes may include a shape corresponding to an automatic rifle, a shape corresponding to a shotgun, or another predetermined shape corresponding to another type of weapon.

Figure 2:
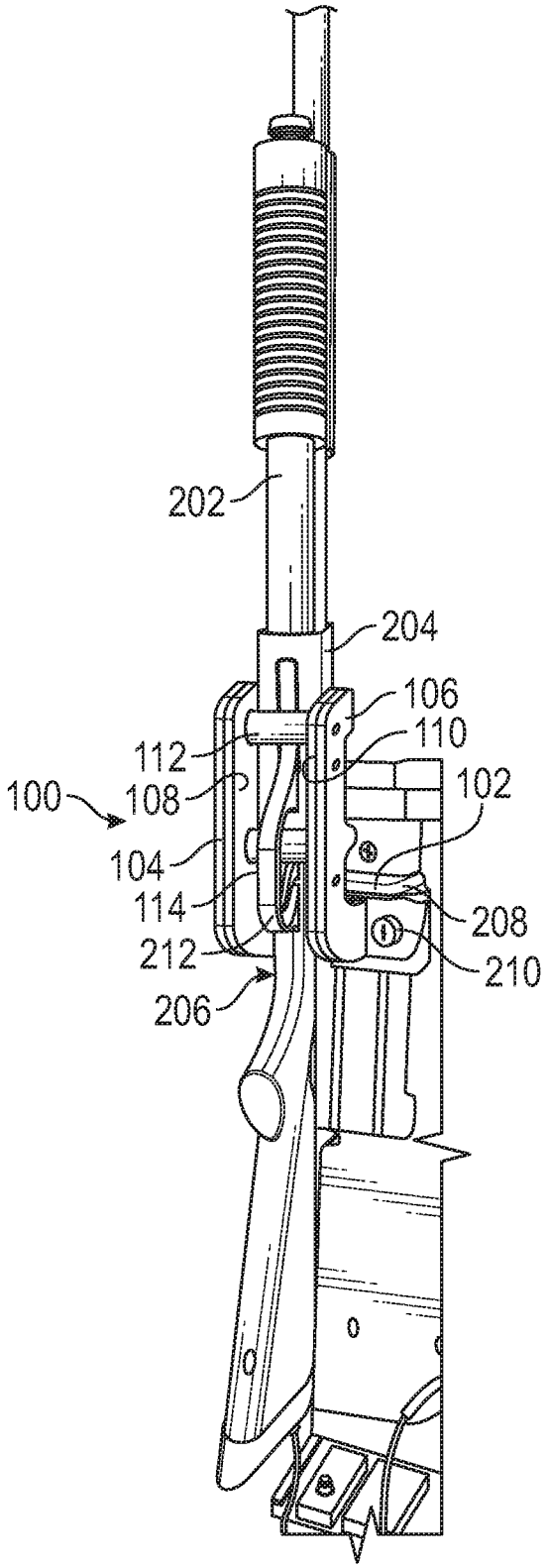
FIG. 2 depicts an embodiment of a weapon security apparatus in a locked and closed state with a weapon inserted therein.

Referring to FIG. 2, an embodiment of a weapon security apparatus 100 is depicted. In FIG. 2, a weapon 202 has been inserted into the weapon security apparatus 100. Further, FIG. 2 depicts the second grip plate 106 as being in a closed position. As in FIG. 1, the apparatus of FIG. 2 may include a base assembly 102, a grip plates 104, 106, grip pads 108, 110, and structural posts 112, 114.

During operation, a weapon 202 may be inserted into the apparatus 100. The second grip plate 106 may be moved from the open position to a closed position such that the grip plates 104, 106 clamp around a receiver 204 of the weapon 202. The grip pads 108, 110 may apply a constant force to the weapon 202 to hold the weapon in place. A distance between the grip plates 104, 106 may be adjustable to accommodate different sized weapons when the second grip plate 106 is in the closed position.

While the weapon 202 is in the apparatus 100, the second structural stud 114 may pass through a trigger guard 212 of the weapon 202. As such, the structural posts 112, 114 may prevent the removal of the weapon 202 from the apparatus 100 and may also provide additional support for the weapon 202. When the weapon 202 is within the apparatus 100, an underside 206 of the weapon may face away from the base assembly 102.

The apparatus 100 may include a handle assembly 208. The handle assembly 208 may be moveable between an open position and a closed position. As the handle assembly 208 moves to the closed position it may actuate the second grip plate 106 causing the second grip plate 106 to move closer to the first grip plate 104, thereby pressing the weapon 202 between the grip plates 104, 106. Once in the close position, the handle assembly may be locked via a key lock 210. The base assembly 102 may further include additional locking mechanisms such as a solenoid, a retractable latch, another type of locking mechanism, or combinations thereof.

An advantage of the apparatus 100 is that by holding the weapon 202 with the underside 206 of the weapon 202 facing away from the base assembly 102, a weapon may fit within the apparatus 100 even when the weapon has an attachment, such as a high capacity magazine attached underneath it. This configuration may also prevent access to the receiver of the weapon, thereby preventing a person from charging the weapon while it is secured. Other advantages may exist.

Figure 3:
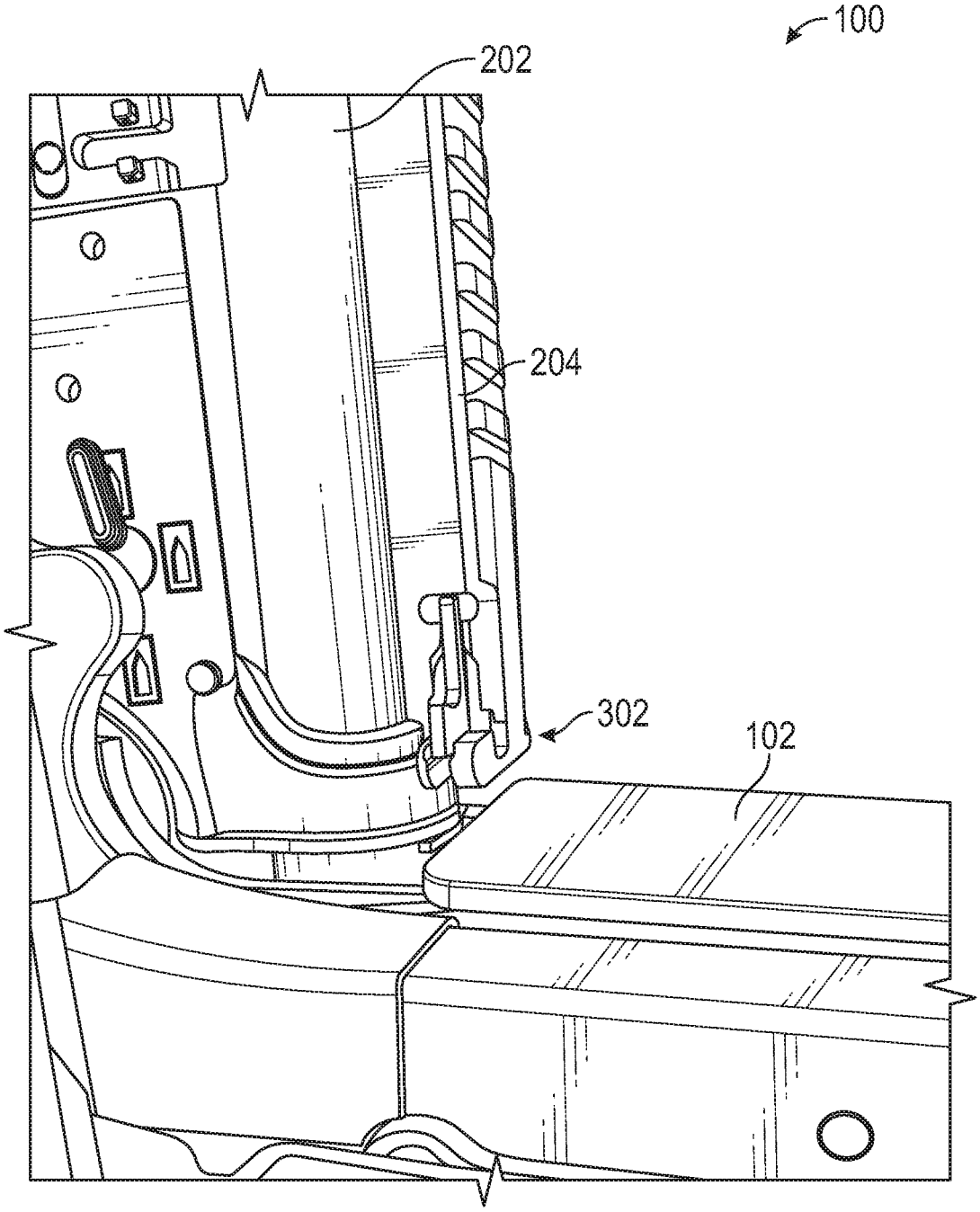
FIG. 3 depicts an embodiment of a weapon security apparatus.

Referring to FIG. 3, an embodiment of a weapon security apparatus 100 is depicted. As described herein, a weapon 202 may be inserted into the apparatus 100 such that a top side 302 of the weapon 202 may be facing the base assembly 102. In this configuration, the base assembly 102 provides interference for the receiver 204 of the weapon 202. As an example, in the case of an automatic rifle (e.g., an AR-15) the base assembly 102 may prevent access to a chamber of the weapon 202. In other cases, the interference may likewise prevent the weapon from being charged while locked in the apparatus 100. For example, the location of the base assembly 102 adjacent to a portion of the top side 302 of the receiver 204 may prevent the charging handle of the weapon 202 from being actuated to charge the weapon 202. Other advantages may exist.

Figure 4:
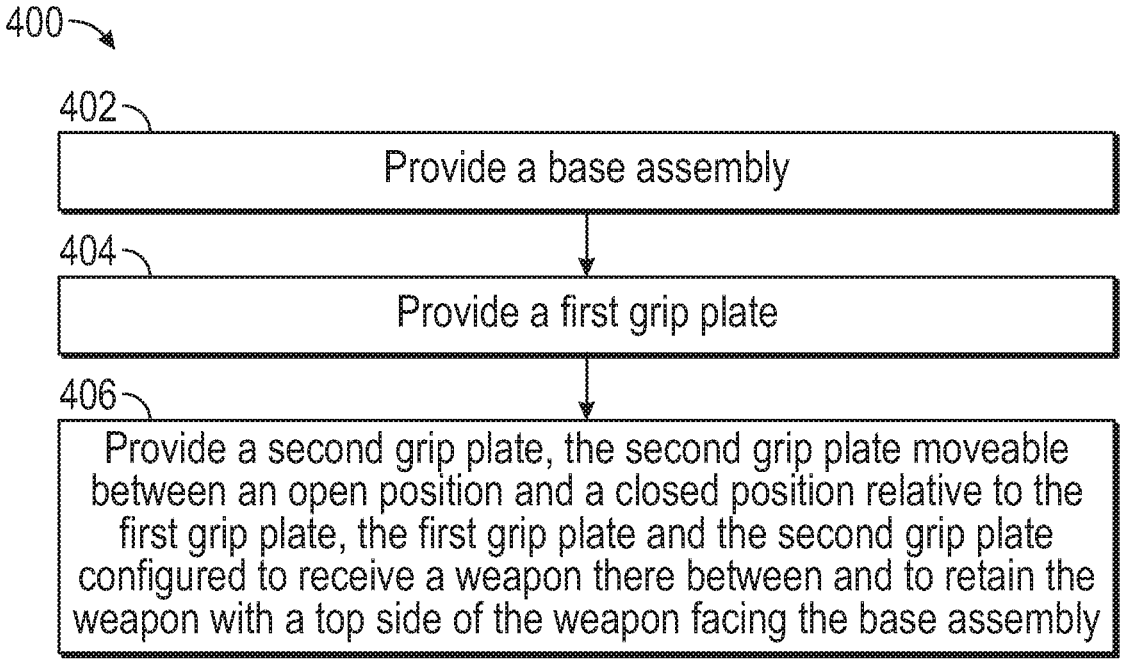
FIG. 4 is a flow chart depicting a method for weapon security.

Referring to FIG. 4, an embodiment of a method 400 for securing a weapon. The method 400 may include providing a base assembly, at 402. For example, the base assembly 102 may be provided as part of a weapon security apparatus 100.

The method 400 may further include providing a first grip plate, at 404. For example, the first grip plate 104 may be provided as part of the weapon security apparatus 100.

The method 400 may also include providing a second grip plate, at 406. The second grip plate moveable between an open position and a closed position relative to the first grip plate. The first grip plate and the second grip plate may be configured to receive a weapon therebetween and to retain the weapon with a top side of the weapon facing the base assembly.

A benefit of the method 400 is that by holding a weapon with a top of the weapon facing the base assembly (with an underside of the weapon facing away from the base assembly 102) a weapon may fit within a weapon security apparatus even when the weapon has an attachment, such as a high capacity magazine, attached to it. This configuration may also prevent access to the receiver of the weapon, thereby preventing a person from charging the weapon while it is secured. Other advantages may exist.

Although various embodiments have been shown and described, the present disclosure is not so limited and will be understood to include all such modifications and variations as would be apparent to one skilled in the art.

What is claimed is:

1. A weapon security apparatus comprising:

a base assembly;

a first planar grip plate; and a second planar grip plate, the second planar grip plate moveable between an open position and a closed position relative to the first planar grip plate, the first planar grip plate and the second planar grip plate configured to receive a weapon therebetween and to secure the weapon with a top side of the weapon facing the base assembly, wherein the first planar grip plate has a first shape defined within a first plane and the second planar grip plate has a second shape defined within a second plane that is geometrically parallel to the first plane, wherein the first shape includes a first trough and a second trough defined within the first plane on a side of the first planar grip that is closest to the base assembly, and wherein the second shape planar grip plate includes a corresponding first trough and a corresponding second trough defined within the second plane on a side of the second planar grip that is closest to the base assembly, wherein the first trough, the second trough, the corresponding first trough, and the corresponding second trough are configured to accommodate a portion of a receiver of the weapon.

2. The apparatus of claim 1 further comprising a first grip pad attached to the first planar grip plate and a second grip pad attached to the second planar grip plate.

3. The apparatus of claim 2, wherein the first grip pad and the second grip pad comprise synthetic rubber.

4. The apparatus of claim 1, wherein the base assembly blocks access to a chamber of the weapon to prevent charging of the weapon while the weapon is secured between the first planar grip plate and the second planar grip plate.

5. The apparatus of claim 1, wherein the first planar grip plate and the second planar grip plate are adapted to secure a shape of an automatic rifle and a shape of a shotgun.

6. The apparatus of claim 1, further comprising at least one structural post coupled to one of the first planar grip plate or the second planar grip plate and configured to retain the weapon when the second planar grip plate is in the closed position.

7. The apparatus of claim 1, wherein a distance between the first planar grip plate and the second planar grip plate, while the second planar grip plate is in the closed position, is adjustable to accommodate different sized weapons.

8. The apparatus of claim 1, further comprising a handle assembly configured to enable a user to move the second planar grip plate between the open position and the closed position.

9. The apparatus of claim 1, wherein the first planar grip plate and the second planar grip plate include stainless steel.

10. A method for weapon security comprising:

providing a base assembly;

providing a first planar grip plate; and providing a second planar grip plate, the second planar grip plate moveable between an open position and a closed position relative to the first planar grip plate, the first planar grip plate and the second planar grip plate configured to receive a weapon therebetween and to retain the weapon with a top side of the weapon facing the base assembly, wherein the first planar grip plate has a first shape defined within a first plane and the second planar grip plate has a second shape defined within a second plane that is geometrically parallel to the first plane, wherein the first shape includes a first trough and a second trough defined within the first plane on a side of the first planar grip that is closest to the base assembly, and wherein the second shape includes a corresponding first trough and a corresponding second trough defined in the second plane on a side of the second planar grip that is closest to the base assembly, wherein the first trough, the second trough, the corresponding first trough, and the corresponding second trough are configured to accommodate a portion of a receiver of the weapon.

11. The method of claim 10 further comprising providing a first grip pad attached to the first planar grip plate and a second grip pad attached to the second planar grip plate.

12. The method of claim 10, wherein the base assembly prevents access to a chamber of the weapon to prevent charging of the weapon while the weapon is locked between the first planar grip plate and the second planar grip plate.

13. The method of claim 10, wherein the first planar grip plate and the second planar grip plate are adapted to secure a shape of an automatic rifle and to secure a shape of a shotgun.

14. The method of claim 10, further comprising providing at least one structural post coupled to one of the first planar grip plate or the second planar grip plate and configured to retain the weapon when the second planar grip plate is in the closed position.

15. The method of claim 10, further comprising providing a first synthetic rubber grip pad attached to the first planar grip plate and a second synthetic rubber grip pad attached to the second planar grip plate.

16. The method of claim 10, wherein a distance between the first planar grip plate and the second planar grip plate is adjustable to accommodate different sized weapons.

17. The method of claim 10, further comprising providing a handle assembly configured to enable a user to move the second planar grip plate between the open position and the closed position.

18. The method of claim 10, wherein the first planar grip plate and the second planar grip plate include stainless steel.

19. A weapon security apparatus comprising:

a base assembly;

a lock assembly configured to receive a weapon therein and to retain the weapon while in a locked state and to release the weapon when in an unlocked state, wherein the weapon is retained between a first planar grip plate and a second planar grip plate while in the locked state with a top side of the weapon facing the base assembly, wherein the second planar grip plate is moveable between an open position in the unlocked state and a closed position in the locked state, wherein the first planar grip plate has a first shape defined within a first plane and the second planar grip plate has a second shape defined within a second plane that is geometrically parallel to the first plane, wherein the first shape includes a first trough and a second trough defined in the first plane on a side of the first planar grip that is closest to the base assembly, and wherein the second shape includes a corresponding first trough and a corresponding second trough defined in the second plane on a side of the second planar grip that is closest to the base assembly, wherein the first trough, the second trough, the corresponding first trough, and the corresponding second trough are configured to accommodate a portion of a receiver of the weapon.

20. The apparatus of claim 1, wherein the first planar grip plate and the second planar grip plate extend outward from the base assembly in parallel to each other.

* * * * *